US005511662A

United States Patent [19]

Amoroso et al.

[11] Patent Number: 5,511,662

[45] Date of Patent: Apr. 30, 1996

[54] FOAM RUBBER TOOL RETAINER

[76] Inventors: Dennis J. Amoroso, 5266 Turnberry Pl., San Jose, Calif.; Harold G. Amoroso, 2200 Monroe St. #1508, Santa Clara, Calif.

[21] Appl. No.: 143,493

[22] Filed: Oct. 25, 1993

[51] Int. Cl.[6] ..... B65D 85/28

[52] U.S. Cl. ..... 206/373; 206/376; 206/378; 206/490

[58] Field of Search ..... 206/372, 373, 206/376, 378, 379, 486–490, 523, 592, 594, 459.5

[56] References Cited

U.S. PATENT DOCUMENTS

| | | | |
|---|---|---|---|
| 388,334 | 8/1888 | Bartlett | 206/379 |
| 400,288 | 3/1889 | Bartlett | 206/379 |
| 3,102,637 | 9/1963 | Scholl, Sr. | 206/379 |
| 3,367,483 | 2/1968 | Studen | 206/379 |
| 3,777,882 | 12/1973 | McIntyre | 206/523 |
| 4,340,140 | 7/1982 | Wilcox et al. | 206/373 |
| 4,621,738 | 11/1986 | DeLucchi | 206/378 |
| 4,688,672 | 8/1987 | Pemberton | 206/378 |
| 4,703,161 | 10/1987 | McLean | 206/523 |
| 4,726,843 | 4/1988 | Leonard | 206/372 |
| 4,754,880 | 7/1988 | Tehrani | 206/523 |
| 4,762,227 | 8/1988 | Patterson | 206/523 |
| 4,770,297 | 9/1988 | Chang | 206/379 |
| 4,824,059 | 4/1989 | Butler | 206/523 |
| 4,883,179 | 11/1989 | Dionne | 206/523 |
| 4,938,355 | 7/1990 | Rocco | 206/372 |
| 5,040,678 | 8/1991 | Lenmark, Sr. et al. | 206/523 |
| 5,080,230 | 1/1992 | Winnard | 206/378 |
| 5,195,633 | 3/1993 | Kaminski | 206/490 |
| 5,259,502 | 11/1993 | Chan | 206/372 |

FOREIGN PATENT DOCUMENTS

| | | | |
|---|---|---|---|
| 806000 | 6/1951 | Germany | 206/373 |
| 95761 | 10/1960 | Netherlands | 206/378 |

*Primary Examiner*—David T. Fidei

*Attorney, Agent, or Firm*—Townsend and Townsend and Crew

[57] ABSTRACT

A retainer for holding a plurality of tools (10), (16), (17), (18), comprising a retention layer (12) having opposed first and second sides and a planar, horizontally disposed top containing a plurality of openings (11) supported by a more rigid interlocking base layer (13). The retention layer (12) is configured for gradient depths. The base layer (13) has a diametrically configured upper surface permanently affixed to the lower portion of the retention layer (12) to provide a rigid planar base. The openings (11) are formed to accept a plurality of tool shapes particular to the individual retainer. Color contrast between the retention layer (12) and base layer (13) provides visual recognition of missing tools. The retention layer (12) has a smooth top surface to accept the permanent application of size markings (14) and other pertinent information including graphics which gives the retainer the ability to be custom designed.

4 Claims, 4 Drawing Sheets

FOAM RUBBER TOOL RETAINER

BACKGROUND—FIELD OF INVENTION

This invention relates to hand tool retainers used in tool boxes and cases, specifically for the retention and organization of tools to facilitate daily use and prevention of loss.

BACKGROUND—DESCRIPTION OF PRIOR ART

Mechanical and electronic technicians in all industries invest in large numbers of hand tools. These are stored in tool boxes or cases which need to be organized for efficiency. Hand tools are made in many different sizes and shapes which are difficult to organize and store. The loss of tools is inevitable when they are stored in a disorganized fashion.

Originally tools were laid on the bare surface of the steel drawer of the tool box or on a rubber or cloth mat. This system was difficult to keep organized and the mechanic had no readily available way of identifying missing tools.

To solve these problems several items are in use for holding and organizing tools. Snap-On Tool Co. part number A267 uses a fiat metal bar as a rail which has spring clips slid onto it for holding sockets. These rails are inexpensive to manufacture and hold the sockets in an organized sequence. But they must be installed to the drawer surface with screws which damage the drawer permanently. The spring clip attached to the rail holds the socket so tightly it is difficult to remove. Also the sheet metal rail will scratch any painted or polished surface it contacts.

U.S. Pat. No. 4,337,860 to Carrigan (1981) shows a second style of socket holder as a fiat rail with movable pegs which the socket is set onto. This rail is inexpensive to manufacture and will not scratch painted surfaces. However, it is not movable and the pegs loosen in the rail. It does not retain the sockets in a positive grip allowing them become disorganized during use or movement of the tool box.

Wrench retainers are of one basic design. Two rails, Snap-On Tool Co. part numbers KRA 15 and YA 381, either separate or fixed, lie at an angle to each other to accommodate graduated lengths. The ridge of each rail is notched at an angle to hold the wrench on its side with the size markings visible towards the front. These are plastic or metal and must also be permanently mounted to the drawer surface to prevent movement. One style has no positive grip to retain the tool firmly. Wrenches fall off the rails during use or movement of the tool box. An updated design, the Spanger model 850 built by Hotchkiss Development Co. with a patent pending, uses a spring grip on the center balance point of the wrench making handling difficult.

U.S. Pat. No. 5,147,038 to Pergeau (1991) shows a tool retainer with a number of different shaped orifices for individual tools which are not sets and it is not designed to be stored in a drawer or case.

The tool retainers heretofore known have several disadvantages:

(a) Their design does not allow the tool to be easily handled while providing firm retention.

(b) Mounting them to a drawer surface requires the use of glue or screws damaging the drawer.

(c) They are narrow and the colors blend with the background making it difficult to notice missing tools.

(d) They are designed for use with only one tool and the basic design is not versatile enough to be readily and economically changed for use with a variety of shapes and sizes.

(e) The metal material used in their manufacture can easily damage any surface it contacts and the method of manufacture leaves sharp edges which cause discomfort when contacted by ones finger tips.

(f) Their paint, which reacts to solvents and gasoline, will blister or peel and is difficult to clean.

OBJECTS AND ADVANTAGES

Accordingly, the objects and advantages of our invention are:

(a) to provide a tool retainer which maintains positive retention of the tool while allowing it to be easily removed;

(b) to provide a tool retainer which is installed in a tool box drawer without damage to the drawer;

(c) to provide a tool retainer which readily identifies a missing tool;

(d) to provide a tool retainer whose structure is easily and inexpensively altered for use with a variety of tools;

(e) to provide a tool retainer whose material is soft for comfortable handling and which will not damage any surface it contacts; and (f) to provide a tool retainer which is impervious to caustic fluids and is easily cleaned.

Further objects and advantages are to provide a retainer which is simple to use and can be easily adapted to any shape or size of tool in present or future use, whose production and materials allows it to be produced in a variety of colors for the purpose of color coding, whose material is easy to handle allowing daily use without damage to the technicians hands, which is manufactured in modules for use with all sizes of tool boxes and cases, and which is easily cleaned. Still further objects and advantages will become apparent from a consideration of the ensuing description and drawings.

DRAWINGS FIGURES

Reference Numerals in Drawings

| | | | |
|---|---|---|---|
| 10 | socket | 15 | grip access opening |
| 11 | retention opening | 16 | wrench |
| 12 | retention layer | 17 | extension |
| 13 | support layer | 18 | screwdriver |
| 14 | size markings | | |

DESCRIPTION—FIGS. 1 to 4

Figure 1:
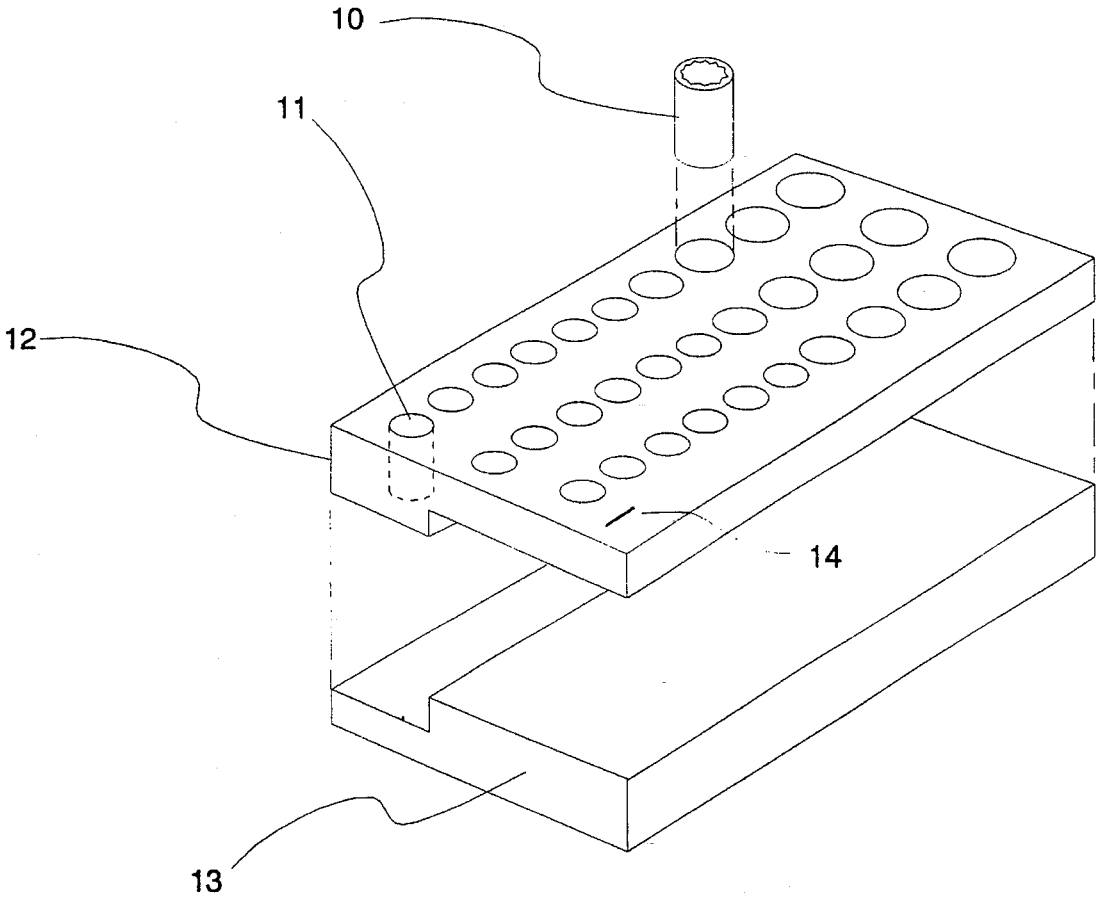
FIG. 1 shows a retainer used for sockets with the two layers notched into each other to provide a set of deep holes to the rear for tall sockets.

A typical embodiment of the retainer of the present invention is illustrated in FIG. 1 perspective view. The retainer has a support layer 13 of a rigid material such as expanded polystyrene. However this layer can be made of any other material which will support the weight of the tools and remain rigid with repeated use, such as plastic, plasticized cardboard, sheet metal, vinyl, wood, etc. A support layer could also be provided in a single piece of material by the partial compression of the lower portion of that material during the manufacturing process thus eliminating the need for two seperate pieces.

The upper retention layer 12 contains retention openings 11 punched through the full depth in shapes for accommodating a particular tool. The retention layer 12 is made of a soft open cell foam material such as nitrile butadiene rubber with a closed cell smooth surface. This material was chosen for its unique gripping qualities but any smooth surfaced material can be used. The smooth surface accepts the silk screened size markings 14 which enable easy identification. In the preferred embodiment the two layers 12 and 13 are permanently affixed to become one piece. The two layers are of contrasting designer colors to enable the easy identification of missing tools and enhance the work environment. This design can be duplicated from one piece of material by compressing the lower portion into a more rigid layer although this is an expensive process and the contrast in colors would not be possible.

Figure 2:
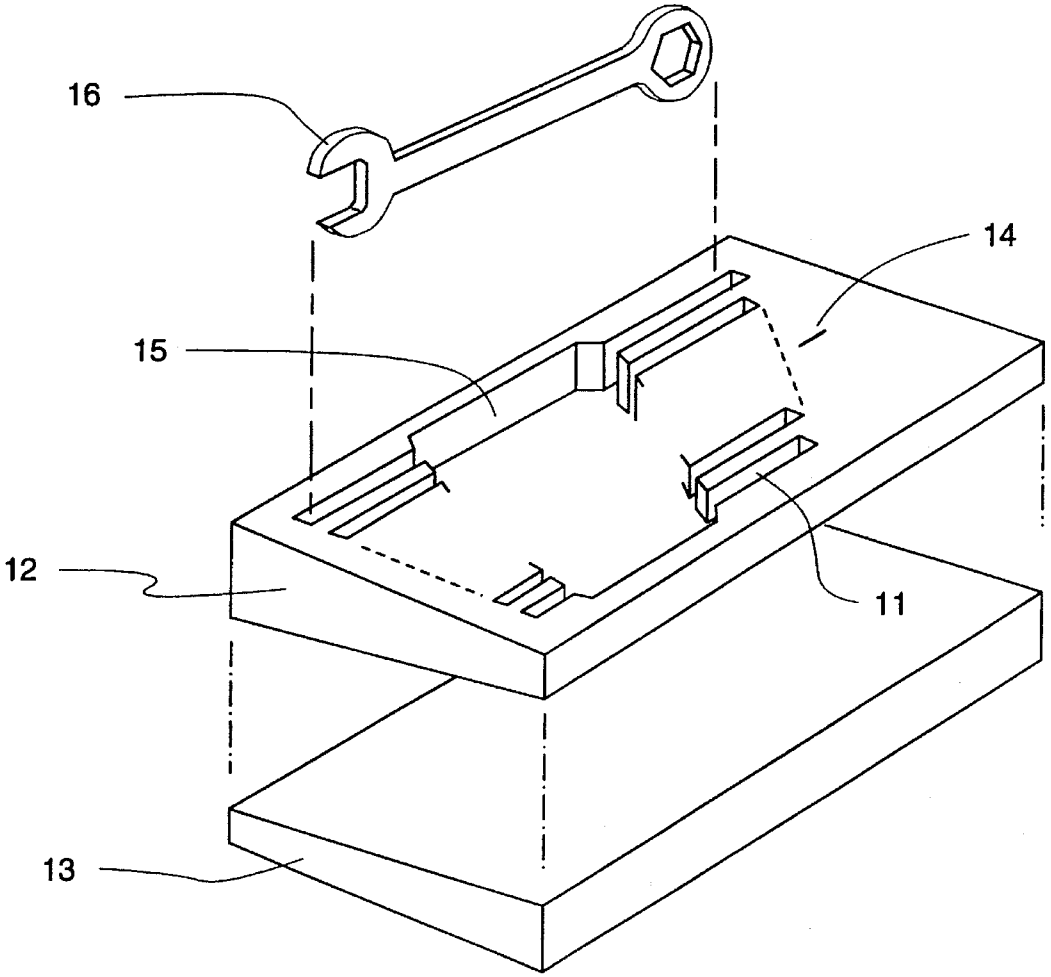
FIG. 2 shows a retainer for wrenches with the two layers beveled to each other to provide the necessary changes in depth for accommodating sequentially larger wrenches.
Figure 3:
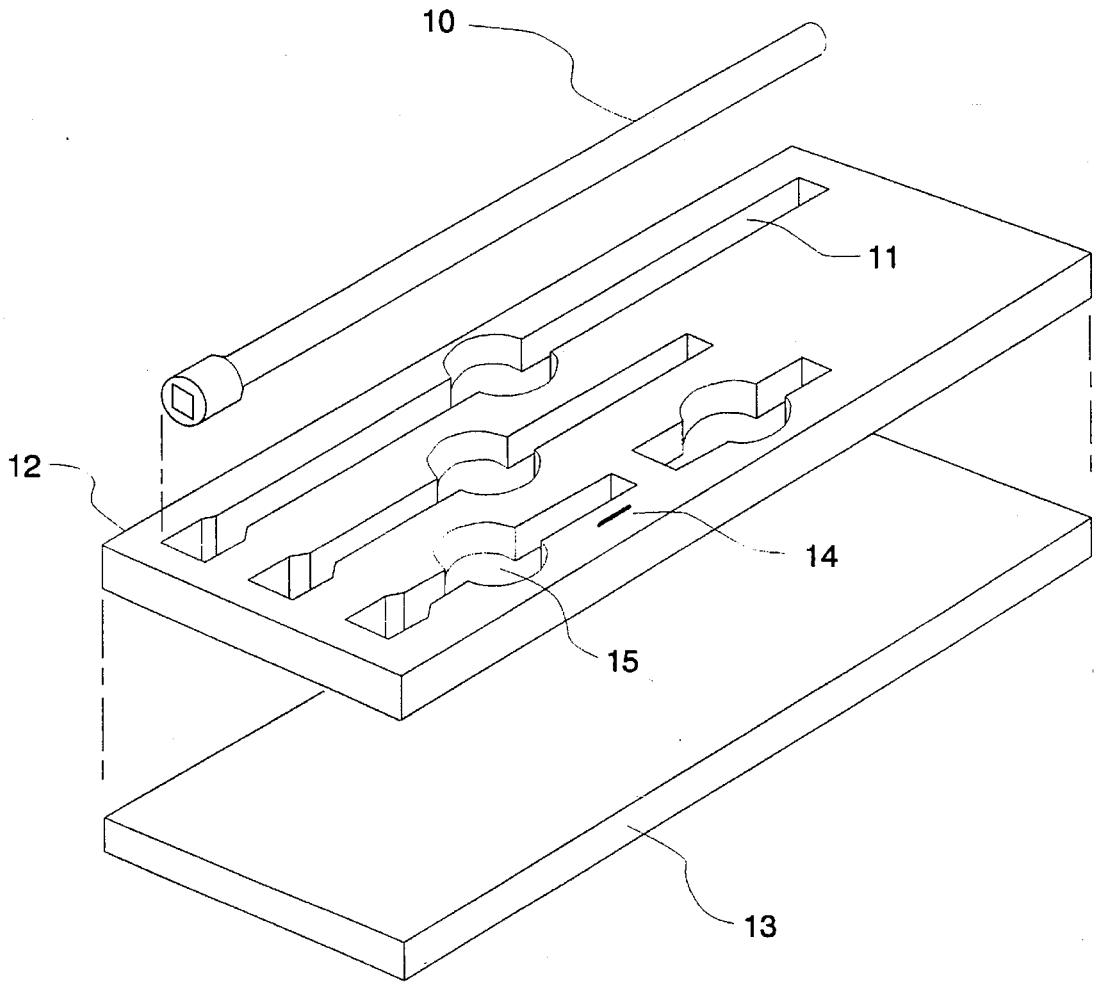
FIG. 3 shows a retainer with a rigid support layer for a set of socket extensions.
Figure 4:
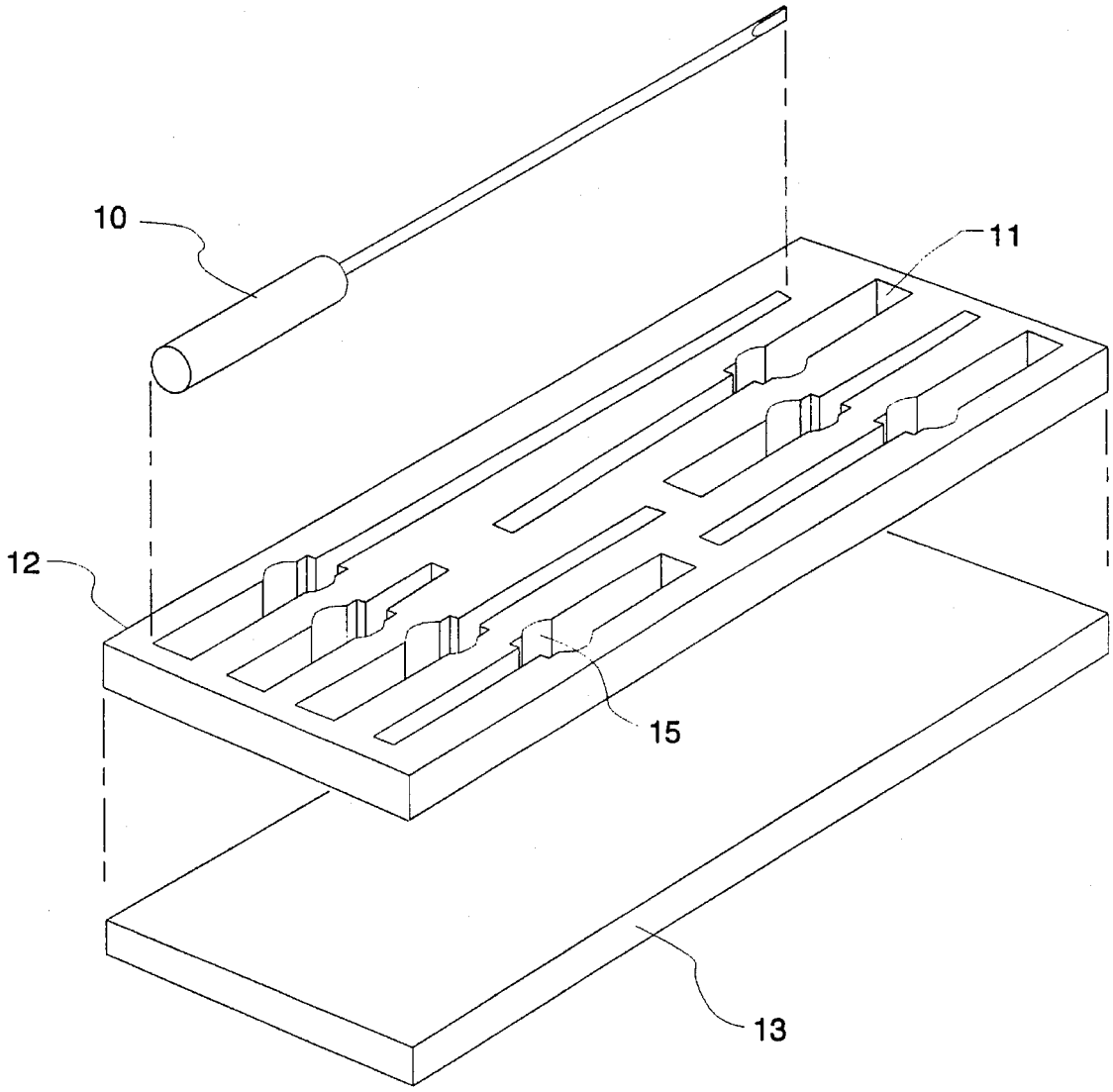
FIG. 4 shows a retainer with a rigid support layer for a set of screw drivers.

In FIG. 1 the rear of the base 13 is notched thinner to accept the thicker segment of the retention layer 12 to accommodate deeper sockets 10 on that row. In FIG. 2 the layers 12 and 13 are diametrically beveled to accommodate progressively larger wrenches 16. In FIGS. 3 and 4 the layers are the same thickness.

In FIG. 1 the retention opening 11 is round to accommodate round sockets 10. In FIG. 2 the retention opening 11 is a groove for accommodating a wrench 16. In this embodiment a grip access opening 15 is cut from the center to provide access to the balance point of the wrench for handling. This grip access opening 15 is shown in FIGS. 3 and 4 as a rounded opening for access to the balance points of the extensions 17 and screwdrivers 18. In each of the embodiments the retention opening fits the tool shape to keep it in place and also identify the tool.

From the description above a number of advantages of our foam rubber tool retainer become evident:

(a) The basic design can be adapted to fit any tool and any tool box or case.

(b) The contrasting colors can be easily changed to adapt to customer requests.

(c) The use of foam rubber makes it easy to use, inexpensive to manufacture, and long lasting.

Operation—FIGS. 1 to 4

The manner of using the foam rubber tool retainer is very simple since it has no moving parts and is stationary while in use. The two permanently attached layers 12 and 13 are placed in a suitably sized tool drawer. The socket 10 in FIG. 1 or the wrench 16 in FIG. 2 is positioned into its properly sized retention opening 11.

The socket 10 in FIG. 1 remains above the surface of the retainer far enough to enable gripping. In FIGS. 2,3,4 the grip access opening 15 is used to enable gripping the tool at its balance point. The size markings 14 are highly visible providing fast efficient identification of exact sizes.

When the retainer is fully loaded with tools it can be left in the drawer or moved to the work area without fear of loosing tools or damaging sensitive surfaces. Tool drawers, boxes, and cases can be color coordinated for better identification of sections. The user can also personalize tool storage areas.

SUMMARY, RAMIFICATIONS, AND SCOPE

Accordingly the reader will see that the foam rubber tool retainer of this invention will retain tools while allowing them to be easily removed, can be used for years without damage or wear to many different sized boxes or cases, will readily identify missing tools, can be quickly and inexpensively altered in shape to accommodate an infinite number of different tool shapes, is comfortable to handle and will not damage contacting surfaces, and can be easily maintained during use in harsh environments.

While the description above holds many specificities it should not be construed as limitations on the scope of the invention, but rather as an exemplification of one preferred embodiment. Many variations are possible such as; retention layers made thicker for use with electric or air drive wrenches and drills, colors coordinated with size or style of tool, custom fitted retainers for specialty tools, complete matched sets, etc.

Thus the scope of the invention should be determined by the appended claims and their legal equivalents, rather than by the examples given.

We claim:

1. A tool retainer for retaining and organizing tools comprising:

a support layer having a first color, wherein said support layer has a plurality of depths to support tools of different sizes; and a retention layer overlaying said support layer, said retention layer having a second color and a plurality of openings therethrough that retain tools;

whereby said first and second colors allow a user to readily recognize which openings in said tool retainer do not contain tools.

2. The tool retainer of claim 1 wherein said depths in said support layer are graduated.

3. A tool retainer for retaining and organizing tools comprising:

a support layer having a first color and a plurality of depths to support tools of different sizes;

a retention layer overlaying said support layer, said retention layer having a second color and a plurality of openings therethrough that retain tools; and markings on said retention layer to indicate tools retained in said openings in said retention layer;

wherein said first and second colors are contrasting colors to allow a user to readily recognize which openings in said tool retainer do not contain tools.

4. The tool retainer of claim 3 wherein said depths in said support layer are graduated.

* * * * *